US007378012B2

(12) United States Patent
Yokoo

(10) Patent No.: US 7,378,012 B2
(45) Date of Patent: May 27, 2008

(54) METHOD FOR REFORMING LUBRICATING OIL USED IN LUBRICATING AN ENGINE WITH A SLIDING REGION

(76) Inventor: Naoto Yokoo, 1-14-1, Einomaruminamimachi, Yahatanishi-ku, Kitakyushu-shi, Fukuoka 807-0845 (JP)

( * ) Notice: Subject to any disclaimer, the term of this patent is extended or adjusted under 35 U.S.C. 154(b) by 589 days.

(21) Appl. No.: 10/494,943

(22) PCT Filed: Nov. 19, 2002

(86) PCT No.: PCT/JP02/12050

§ 371 (c)(1),
(2), (4) Date: May 7, 2004

(87) PCT Pub. No.: WO03/044142

PCT Pub. Date: May 30, 2003

(65) Prior Publication Data

US 2004/0262196 A1 Dec. 30, 2004

(30) Foreign Application Priority Data

Nov. 19, 2001 (JP) ..... 2001-353676

(51) Int. Cl.
*C10M 175/00* (2006.01)

(52) U.S. Cl. ..... 208/179; 204/513; 205/696; 208/402

(58) Field of Classification Search ..... 204/513; 205/688, 696; 208/18, 19, 179, 402; 210/748
See application file for complete search history.

(56) References Cited

U.S. PATENT DOCUMENTS 3,398,082 A * 8/1968 Lochmann et al. ..... 204/665
4,052,289 A * 10/1977 Tobisu ..... 204/673

FOREIGN PATENT DOCUMENTS

| | | |
|---|---|---|
| JP | 38-24473 | 11/1963 |
| JP | 57-174399 | 10/1982 |
| JP | 57-207700 | 12/1982 |
| JP | 58-7494 | 1/1983 |
| JP | 58-63785 | 4/1983 |
| JP | 62-297395 | 12/1987 |
| JP | 2-238090 | 9/1990 |
| WO | 99/03556 | 1/1999 |
| WO | 99/04062 | 1/1999 |

* cited by examiner

*Primary Examiner*—Glenn Caldarola
*Assistant Examiner*—Randy Boyer
(74) *Attorney, Agent, or Firm*—Wenderoth, Lind & Ponack, L.L.P.

(57) ABSTRACT

A method for reforming a lubricating oil which includes holding stably a container (6) containing a lubricating oil (5) on a stand (4) being insulated from the earth with four high-voltage insulators (3), and applying an electrostatic potential of 30 to 50 volts by the use of an electrostatic charge generating device (7), to thereby charge electrons to the lubricating oil (5). The charge of electrons converts an unsaturated hydrocarbon (1*a*) and an aromatic hydrocarbon (2*a*) in the lubricating oil (5) to a saturated hydrocarbon (1*b*) or (2*b*) and a naphthenic hydrocarbon (2*c*), which reduces the viscosity of the lubricating oil. Accordingly, the use of the lubricating oil (5) in an internal combustion engine lowers the friction resistance therein, which leads to a decrease in the fuel consumption of the engine. The method allows, therefore, the enhancement of fuel economy, in combination with the suppression of oxidation of the lubricating oil itself.

6 Claims, 2 Drawing Sheets

METHOD FOR REFORMING LUBRICATING OIL USED IN LUBRICATING AN ENGINE WITH A SLIDING REGION

BACKGROUND OF THE INVENTION

1. Field of the Invention

The present invention relates to a method for reforming a lubricating oil used in an engine with a sliding region, as well as the reformed lubricating oil and, more particularly, relates to a method for reforming a lubricating oil that is suitable for the lubricating oil used in an internal combustion engine, as well as such a lubricating oil.

2. Description of the Related Art

Current energy problems are extremely important issues, both environmentally and in terms of their effect on the future makeup of human society. Reducing the consumption of petroleum-processed fuels such as gasoline, in particular, plays a major role in protecting the environment and conserving energy, and is also directly linked with cost reductions for both companies and individuals. However, improving the mechanical construction of the internal combustion engine, which functions as the power source for transport machines such as automobiles, ships, and aircraft, in order to enhance fuel efficiency, requires enormous investment in terms of facilities and time for research and development.

Furthermore, as it is difficult to improve the internal combustion engine construction of transport machines that are already in operation, fuel consumption efficiency is improved by reducing the friction loss within the sliding regions of the internal combustion engine. Improving the quality of the lubricating oil used for lubricating the sliding regions is a typical method used to reduce friction loss within an internal combustion engine. For example, methods for improving the lubricating oil include methods for adjusting the viscosity of the base oil itself and methods in which an additive is mixed with the lubricating oil.

However, the lubricating oil inside an internal combustion engine deteriorates, that is, oxidizes with the passage of time and operation of the internal combustion engine. As this oxidation progresses, the viscosity of the lubricating oil rises, increasing the sliding resistance. As a result, incomplete combustion becomes increasingly likely to occur within the combustion chamber of the internal combustion engine, and impurities such as carbon produced by incomplete combustion accumulate inside the combustion chamber. Furthermore, as the viscosity of the lubricating oil increases, consumption of the lubricating oil itself also accelerates.

These types of problems can also occur with lubricating oils that have been improved using the conventional methods described above, and the above conventional methods do not prevent the progression of oxidation of the lubricating oil. Accordingly, conventional lubricating oils need to be changed within a relatively short cycle, and if improved high grade lubricating oils such as those described above are used, the running costs are considerable.

The present invention provides a method for reforming a lubricating oil and the reformed lubricating oil, which suppress oxidation of the lubricating oil itself as far as possible, while minimizing the friction loss within the internal combustion engine and reducing the fuel consumption.

SUMMARY OF THE INVENTION

A method for reforming a lubricating oil according to the present invention comprises the steps of putting the lubricating oil into a container being insulated to the earth, and applying electrons to the lubricating oil via an electrode. According to the present invention, the electrons can effectively be charged to the lubricating oil, without leaking to ground. Energizing of the electrode is conducted by applying a voltage of at least 30 volts for a period of at least 100 hours, and preferably for a longer period of at least 400 hours. Conducting this energizing at a voltage of at least 50 volts for a period of at least 720 hours is even more desirable.

If energizing is performed at a voltage of at least 30 volts for at least 100 hours, a lubricating oil in which the integrated intensity of H of saturated hydrocarbons in a nuclear magnetic resonance spectrum is at least 3% can be obtained. In a lubricating oil with a H integrated intensity of at least 3%, as the quantity of unsaturated hydrocarbons is extremely low, the viscosity of the lubricating oil is also low. In other words, by reducing the quantity of unsaturated hydrocarbons, the frictional resistance can be significantly reduced.

Furthermore, if energizing is performed at a voltage of at least 30 volts for at least 400 hours, the above H integrated intensity becomes extremely stable, and a low viscosity state can be maintained for extended periods. In addition, if charging is performed at a voltage of at least 50 volts for at least 720 hours, then the above H integrated intensity increases up to 5 to 7%, and the low viscosity state becomes stable.

The inventor of the present invention has confirmed by testing that a lubricating oil that had been charged with minus electrons by the reforming method according to the present invention displayed a reduced viscosity, and found that the frictional resistance within an internal combustion engine using this lubricating oil could also be reduced. This enables a reduction in the fuel consumption for the internal combustion engine. By using a simple apparatus such as that described above, comprising a container being insulated to the earth and an electrode for applying electrons to the lubricating oil held inside the container, a conventional low cost lubricating oil can be processed to produce a lubricating oil of the present invention. Consequently, the cost of reforming lubricating oils can be kept to a minimum.

Furthermore, exhaust gases emitted from internal combustion engines are said to contain a mass of plus ions, but a lubricating oil produced by the present invention contains a large quantity of minus electrons, and consequently the quantity of plus ions contained with the emitted exhaust gases can be reduced. By using a lubricating oil that has been charged with minus electrons in this manner for lubricating the internal combustion engine, oxygen within the combustion chamber can be negatively ionized, thereby preventing incomplete combustion within the combustion chamber. In other words, since complete combustion can be ensured, oxidation of the lubricating oil can be suppressed. Furthermore, as the unsaturated hydrocarbon component of the lubricating oil is almost entirely converted to saturated hydrocarbons, the lubricating oil itself is also extremely resistant to oxidation.

As shown in FIG. 1(*a*), a typical lubricating oil (before processing) is a mixture of unsaturated linear hydrocarbons 1*a* with double bonds and aromatic hydrocarbons 2*a* with benzene rings. When this type of lubricating oil is applied with electrons, the double bonds of the unsaturated hydrocarbons 1*a* break, forming saturated hydrocarbons 1*b*, as shown in FIG. 1(*b*). Furthermore, alkyl groups (R) bond to the benzene rings of the aromatic hydrocarbons 2*a*, forming saturated hydrocarbons 2*b*. Alternatively, the benzene ring of the aromatic hydrocarbon 2*a* can also form a naphthene ring, generating a naphthenic hydrocarbon 2*c*.

In this manner, applying the lubricating oil with electrons causes reduction in the proportion of the aromatic hydrocarbons 2*a*. The viscosity of the aromatic hydrocarbons 2*a* is high. However, it is inferred that, since the present invention enables the proportion of these aromatic hydrocarbons 2*a* to be reduced, the viscosity of the lubricating oil can also be reduced. Oxidation of the lubricating oil proceeds with removing an electron from around an atomic nucleus. In the present invention, however, as the lubricating oil has been charged with minus electrons for an extended period and thus the unsaturated hydrocarbons 1*a* have been almost entirely removed, the product lubricating oil is extremely resistant to oxidation.

Meanwhile in the lubricating oil that has been applied with electrons as described above, not only does the viscosity decrease, but the oiliness also tends to deteriorate. The oiliness indicates the degree of oil adsorption at the friction surface and, in the case of an internal combustion engine, indicates the degree of adhesion of the lubricating oil covering the internal side walls of the combustion chamber. If the lubricating oil that has been applied with electrons is solely used for lubrication in a vehicle internal combustion engine in situations other than high speed running, where marked road variations such as hills or undulations are present, fuel consumption is superior to that obtained with a conventional lubricating oil. However, in order to ensure that this fuel consumption improvement effect is maintained over an extended period, a lubricating oil that has not been applied with electrons is preferably mixed with the lubricating oil applied with electrons. This mixing produces lubricating oil in which the viscosity of the oil is reduced without lowering the oiliness.

When this type of lubricating oil is used for lubrication in a vehicle internal combustion engine, the reduced viscosity enables the frictional resistance of the lubricating oil to be considerably reduced. At the same time, the oiliness has not been lowered, thereby maintaining the adhesion of the lubricating oil covering the side walls inside the combustion chamber. In other words, the viscosity can be reduced and the frictional resistance considerably lowered without decreasing the oiliness of the conventional lubricating oil. Consequently, the fuel consumption can be improved also in high speed running, where marked road variations such as hills or undulations are present.

The mixing ratio of the lubricating oil applied with electrons to the lubricating oil that has not been applied with electrons is preferably within a range from 18:82 to 50:50. If mixing is performed within this range, sufficient effects of reforming a lubricating oil by the present invention can be obtained. Furthermore, if this mixing ratio is kept within a range from 20:80 to 25:75, the optimum lubricating oil reforming effects can be exhibited.

DETAILED DESCRIPTION OF THE INVENTION

Figure 2:
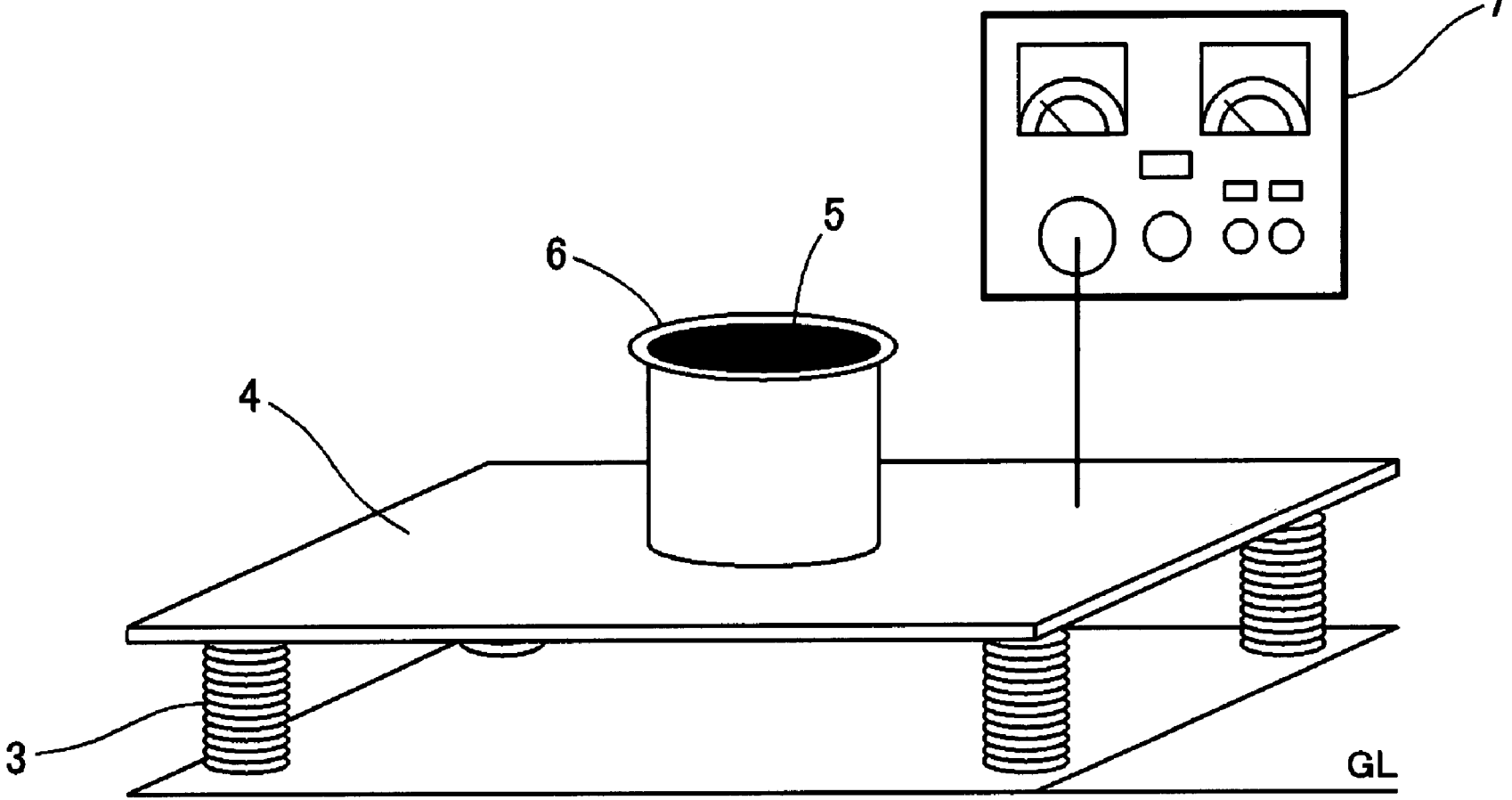
FIG. 2 is a schematic illustration showing a lubricating oil reforming apparatus according to an embodiment of the present invention.

FIG. 2 is a schematic illustration of a lubricating oil reforming apparatus according to an embodiment of the present invention.

As shown in FIG. 2, the lubricating oil reforming apparatus of this embodiment comprises a stand 4 that is insulated to the earth with four high-voltage insulators 3, a container 6 which is secured to the stand 4 and contains a lubricating oil 5 to be reformed, and an electrostatic charge generating device 7 for generating an electrostatic potential of 30 to 50 volts.

The stand 4 is made of stainless steel, is insulated to the earth with the insulators 3, and is energized by the application of an electrostatic potential generated by the electrostatic charge generating device 7. SP30 (impulse withstand voltage: 200 KV, wet power-frequency withstand voltage: 85 KV/min) manufactured by NGK Insulators, Ltd. can be used for the insulators 3, for example. In order to improve the insulation, the size or number of these insulators may be increased as is deemed appropriate. Furthermore, the electrostatic charge generating device 7 is also insulated to the earth so that leakage to earth is prevented and the stand 4 can be efficiently charged.

In addition, the container 6 is also made of stainless steel, and is electrically connected with the stand 4. With this type of container 6, energizing the stand 4 from the electrostatic charge generating device 7 causes the container 6 to also be applied with electrons. In this embodiment, the stand 4 is made of stainless steel in order to further improve the energizing of the container 6. However, other materials may also be used, provided that the container 6 can still be energized.

Furthermore, in order to allow the electrons to readily penetrate into the lubricating oil 5, an electrode (not shown in the drawing) formed from activated carbon is installed inside the container 6. This type of activated carbon electrode adsorbs any impurities contained within the lubricating oil 5 in the container 6, thus enabling the electron charging of the lubricating oil 5 to take place more efficiently. In order to remove the adsorbed impurities, this activated carbon electrode is replaced after a predetermined time or a predetermined quantity of processing.

In this type of reforming apparatus, the container 6 containing the lubricating oil 5 is stably held by the stand 4 insulated to the earth, and an electrostatic potential of 30 to 50 volts is applied using the electrostatic charge generating device 7. The apparatus is kept in this charged state for a period at least in a range from 100 to 400 hours or, preferably, for 720 hours. Furthermore, following completion of this predetermined charging period, the apparatus is left without charging for several days, and another charging process for a predetermined period is then repeated. This cycle is repeated several times. By repeating the charging process with intervals, not only can the properties of the lubricating oil 5 be improved, but also the oil can be ripened and stabilized.

Figure 1:
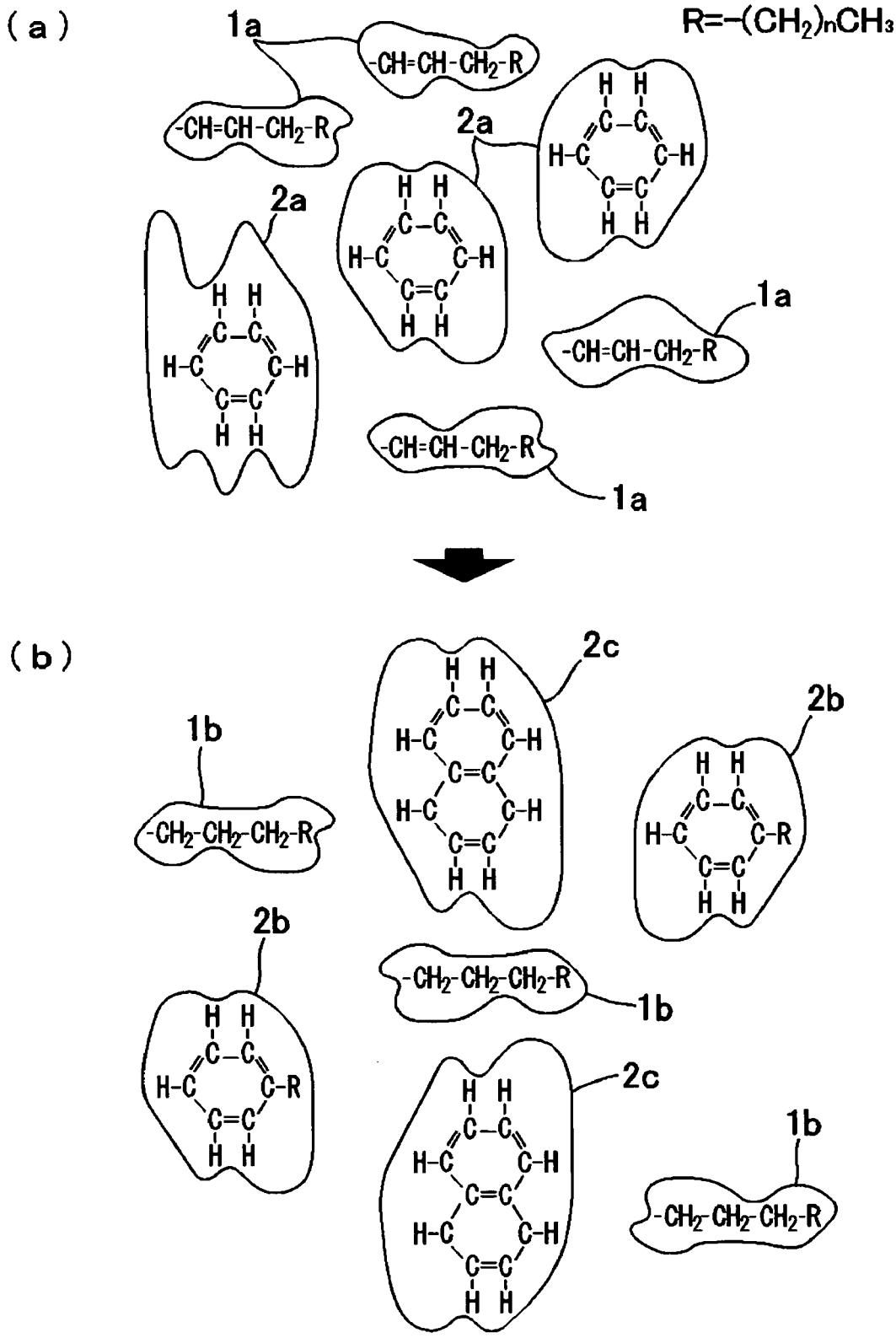
FIG. 1 is a diagram showing the bonding states of molecules within a lubricating oil, wherein (a) shows the state prior to processing, and (b) shows the state following processing.

The lubricating oil 5 obtained in this manner has an extremely low viscosity, with the unsaturated hydrocarbons 1*a* and the aromatic hydrocarbons 2*a* converted to saturated hydrocarbons 1*b*, 2*b* and naphthenic hydrocarbons 2*c* as shown in FIG. 1(*a*) and FIG. 1(*b*). Accordingly, the frictional resistance can be reduced in an internal combustion engine using this lubricating oil, enabling the fuel consumption of the internal combustion engine to be reduced as well. Furthermore, as the electrostatic charge generating device 7 is typically within a price range from 500,000 to 2.6 million yen, the costs associated with producing the lubricating oil 5 of the present embodiment are extremely low, enabling reduction in the running costs compared to the use of conventional high-grade lubricating oils.

Furthermore, since the lubricating oil 5 that has been charged with minus electrons in this manner causes a negative ionization of the oxygen within the combustion chamber, incomplete combustion is prevented and complete combustion occurs and, as a result, oxidation of the lubricating oil 5 can be suppressed. Furthermore, as shown in FIG. 1(*a*) and FIG. 1(*b*), as the unsaturated hydrocarbon 1*a* component of the lubricating oil 5 almost entirely disappears and is converted to saturated hydrocarbons 1*b*, the lubricating oil 5 itself is extremely resistant to oxidation.

A lubricating oil produced using a lubricating oil reforming apparatus according to the present invention was used in practical situations within automobile engines, and the fuel consumption was measured. A cheap lubricating oil was used as a conventional product (conventional example 1), and a sample of the same lubricating oil that had been treated in the manner described above was used as a product of the present invention (example 1). The results of the measurements are shown in Table 1.

TABLE 1

| Sample | Fuel consumption using conventional example 1 (km/L) | Fuel consumption using example 1 (km/L) | Improvement (%) |
|---|---|---|---|
| Vehicle A (displacement: 4,000 cc) | 5.8 | 8.01 | 138 |
| Vehicle B (displacement: 2,000 cc) | 6.5 | 9.45 | 145 |
| Vehicle C (displacement: 550 cc) | 13.5 | 18.02 | 133 |
| Vehicle D (displacement: 1,500 cc) | 9.2 | 12.8 | 139 |
| Vehicle E (displacement: 2,800 cc) | 10.03 | 12.38 | 123 |
| Vehicle F (displacement: 1,300 cc) | 10.1 | 13.02 | 129 |

As is evident from Table 1, in those cases where the lubricating oil of the example 1 was used, improvements in fuel consumption of 20 to 45% were achieved in comparison with those cases where the lubricating oil of the conventional example 1 was used. In other words, even starting with a cheap lubricating oil, by treating the oil using the method of the present invention, the viscosity of the lubricating oil can be lowered, thereby minimizing the frictional resistance and improving the fuel consumption. Furthermore, a nearly 40% reduction in the engine revolutions when idling was also confirmed, which results in an improvement in the level of engine silence as well as reduction in the fuel consumption while idling.

In addition, in comparison with the lubricating oil of the conventional example 1, the lubricating oil of the example 1 is far more resistant to oxidation and less contaminated and, consequently, the oil change cycle can be lengthened by 10 to 30% relative to the conventional product.

Next, a mixture (example 2) of the lubricating oil of the example 1 and the lubricating oil of the conventional example 1 was investigated. The mixing ratio of the example 1 to the conventional example 1 was 20:80. The results of this investigation are shown in Table 2.

TABLE 2

| Property | Example 1 | Example 2 |
|---|---|---|
| Viscosity | Lower than the lubricating oil of the conventional example 1 | Lower than the lubricating oil of the conventional example 1 |
| Oiliness | Lower than the lubricating oil of the conventional example 1 | Similar to the lubricating oil of the conventional example 1 |
| Idling | 700 rpm | 200-400 rpm |
| Fuel consumption | — | On average, at least 10% better than the results obtained using the lubricating oil of the example 1 |

When the sample of each of the lubricating oils from the example 1, the example 2 and the conventional example 1 was placed in a transparent container and inverted, the lubricating oil of the example 1 was less viscous than the lubricating oil of the conventional example 1 and quickly settled with little adhesion to the side walls of the container. This indicates that the lubricating oil has both a lower viscosity and a lower level of oiliness than the conventional example 1.

In contrast, the lubricating oil of the example 2, similar to the lubricating oil of the example 1, was less viscous than the lubricating oil of the conventional example 1, whereas it displayed good adhesion to the side walls of the container, flowing slowly down on the side walls. This indicates that, although the lubricating oil of the example 2 has a lower viscosity than the conventional example 1, the oiliness is not significantly different.

In other words, in the lubricating oil of the example 2, the viscosity was able to be reduced without lowering the oiliness of the conventional lubricating oil.

A vehicle using the lubricating oil of the example 2 displayed rapid accelerator response, an improvement in the torque sensation, good staying power even on hilly roads, and smooth driving in a high gear without unnecessary shift downs. Furthermore, the idling also fell from the 700 rpm observed with the lubricating oil of the example 1 to a value of 200 to 400 rpm, while off-standard incomplete combustion did not occur, and the engine did not stall either.

Furthermore, in terms of the length of time for which the lubricating oil was charged with electrons, a satisfactory effect was observed after energizing for 100 hours or longer. Still, when energizing was conducted for at least 400 hours, and the lubricating oil of the example 2 was formed using an ideal mixing ratio, the effects described above were retained even after driving for 10,000 km or more. With the lubricating oil of the conventional example 1, the fuel consumption began to fall after driving for approximately 4,000 km, indicating that the present invention lengthened the oil lifespan of at least 2.5 fold.

As described above, the present invention is useful as a lubricating oil used in an engine with a sliding region, and is particularly suitable as the lubricating oil used in an internal combustion engine of an automobile or the like.

The invention claimed is:

1. A method for reforming a lubricating oil used in lubricating an engine with a sliding region, the method comprising:

putting the lubricating oil into a container being insulated from the earth;

applying electrons to the lubricating oil via an electrode for a determined charging period;

following completion of the predetermined charging period, leaving the lubricating oil without charging for a plurality of days;

ripening and stabilizing the lubricating oil by repeating the charging process; and mixing a lubricating oil that has not been applied with electrons with the lubricating oil applied with electrons.

2. The method for reforming a lubricating oil used in lubricating an engine with a sliding region according to claim 1, wherein the electrode is energized by applying a voltage of at least 30 volts for a period of at least 100 hours.

3. The method for reforming a lubricating oil used in lubricating an engine with a sliding region according to claim 1, wherein a mixing ratio of the lubricating oil applied with electrons to the lubricating oil that has not been applied with electrons is within a range from 18:82 to 50:50.

4. The method for reforming a lubricating oil used in lubricating an engine with a sliding region according to claim 2, wherein a mixing ratio of the lubricating oil applied with electrons to the lubricating oil that has not been applied with electrons is within a range from 18:82 to 50:50.

5. The method for reforming a lubricating oil used in lubricating an engine with a sliding region according to claim 1, wherein the predetermined charging period is a period of at least 100 hours.

6. The method for reforming a lubricating oil used in lubricating an engine with a sliding region according to claim 1, wherein the charging process, which includes the application of electrons to the lubricating oil for the predetermined charging period and the period during which the lubricating oil is left without charging, is repeated several times.

* * * * *